US008677664B2

(12) United States Patent
Caravaggi et al.

(10) Patent No.: US 8,677,664 B2
(45) Date of Patent: Mar. 25, 2014

(54) STOCK BOLT OF A FIREARM EQUIPPED WITH A DAMPING MECHANISM

(75) Inventors: Fausto Caravaggi, Castegnato (IT); Dario Plebani, Ome (IT); Ivano Contin, Marcheno (IT)

(73) Assignee: Fabbrica d'Armi Pietro Beretta S.p.A., Gardone Val Trompia (Brescia) (IT)

( * ) Notice: Subject to any disclaimer, the term of this patent is extended or adjusted under 35 U.S.C. 154(b) by 399 days.

(21) Appl. No.: 13/001,077

(22) PCT Filed: Jun. 17, 2009

(86) PCT No.: PCT/IB2009/005973

§ 371 (c)(1),
(2), (4) Date: Apr. 6, 2011

(87) PCT Pub. No.: WO2009/156814

PCT Pub. Date: Dec. 30, 2009

(65) Prior Publication Data

US 2011/0179687 A1 Jul. 28, 2011

(30) Foreign Application Priority Data

Jun. 27, 2008 (IT) ..... MI2008A1183

(51) Int. Cl.
*F41A 21/00* (2006.01)

(52) U.S. Cl.
USPC ..... 42/1.06; 42/75.03; 42/16

(58) Field of Classification Search
USPC ..... 42/1.06, 75.03
See application file for complete search history.

(56) References Cited

U.S. PATENT DOCUMENTS

| | | | | | |
|---|---|---|---|---|---|
| 918,447 | A | * | 4/1909 | Hepburn | 89/139 |
| 963,444 | A | * | 7/1910 | Johnson | 42/75.03 |
| 1,755,034 | A | * | 4/1930 | Stange | 42/75.03 |
| 1,852,440 | A | * | 4/1932 | Swebilius | 42/75.03 |
| 2,050,038 | A | * | 8/1936 | Browning | 42/17 |
| 2,090,340 | A | * | 8/1937 | Browning | 89/139 |
| 2,093,169 | A | * | 9/1937 | Holek | 89/159 |
| 2,108,648 | A | * | 2/1938 | Browning | 89/165 |
| 2,144,951 | A | * | 1/1939 | Williams | 89/179 |

(Continued)

FOREIGN PATENT DOCUMENTS

| | | |
|---|---|---|
| DE | 43 461 | 1/1888 |
| FR | 922 904 | 6/1947 |

OTHER PUBLICATIONS

International Search Report issued Nov. 3, 2009 in PCT/1B09/05973 filed Jun. 17, 2009.

*Primary Examiner* — Michelle Clement
(74) *Attorney, Agent, or Firm* — Oblon, Spivak, McClelland, Maier & Neustadt, L.L.P.

(57) ABSTRACT

A bolt (20, 20') for locking the stock (11) to a receiver (12) of a firearm having mobile masses (13), comprising a tubular element (21) which can be closed at the ends respectively by means of a bolt-body cap (22) which can be screwed to the receiver (12) and by means of a bolt -stock cap (23) on which the stock (11) can be tightened, the tubular element housing in its interior a mechanism (40, 40') for damping the withdrawal speed of the mobile masses (13) of the firearm, situated on their withdrawal trajectory and equipped with a free end not connected to the mobile masses (13) and destined for coming into contact with the latter during their withdrawal movement following the firing of the firearm for damping the stress.

16 Claims, 8 Drawing Sheets

(56) References Cited

U.S. PATENT DOCUMENTS

| | | | | |
|---|---|---|---|---|
| 2,320,348 | A * | 6/1943 | Clarkson | 42/16 |
| 2,361,180 | A * | 10/1944 | Dobremysl | 89/1.1 |
| 2,365,188 | A * | 12/1944 | Gorton | 89/197 |
| 3,346,985 | A | 10/1967 | Browning | |
| 3,381,405 | A | 5/1968 | Edwards | |
| 3,977,296 | A * | 8/1976 | Silsby et al. | 89/198 |
| 4,012,859 | A * | 3/1977 | Johansson et al. | 42/75.03 |
| 5,909,002 | A * | 6/1999 | Atchisson | 89/130 |
| 7,162,822 | B1 | 1/2007 | Heayn et al. | |
| 7,681,351 | B2 * | 3/2010 | Bucholtz et al. | 42/1.06 |
| 8,286,382 | B2 * | 10/2012 | Vesligai | 42/75.03 |
| 2008/0110074 | A1 * | 5/2008 | Bucholtz et al. | 42/1.06 |
| 2010/0071246 | A1 * | 3/2010 | Vesligai | 42/75.03 |
| 2010/0122482 | A1 * | 5/2010 | Simms et al. | 42/1.06 |
| 2012/0042556 | A1 * | 2/2012 | Vesligaj | 42/75.03 |
| 2012/0260552 | A1 * | 10/2012 | Vesligaj | 42/1.06 |

* cited by examiner

STOCK BOLT OF A FIREARM EQUIPPED WITH A DAMPING MECHANISM

TECHNICAL FIELD

The present invention relates to a stock bolt of a semi-automatic firearm equipped with a damping mechanism, the use of the same and the relative semi-automatic firearm.

In particular, but not exclusively, the invention relates to a bolt destined for a firearm having the length of a semi-automatic shotgun or competition rifle.

BACKGROUND

During shooting any semi-automatic firearm is subjected to recoil forces.

This phenomenon, a characteristic application of the action-reaction principle, represents the impulse which makes the arm withdraw, due to the impulse the firearm gives to the bullet, firing it.

In the case of long arms, the above-mentioned impulse forces are discharged in the support area of the rifle stock, the shooter's shoulder.

A dynamic analysis of recoils has revealed, for a semi-automatic long arm, the presence of two different acceleration peaks, i.e. two different force impulses.

The first peak, which is larger, is due to the pressure of the cartridge in the barrel during the explosion of the charge, and the first recoil phase is connected to this impulse.

A second peak appears when the mobile masses of the rifle find their run-end, during their withdrawal, producing a second recoil impulse.

Measurements effected during the shooting phase have allowed it to be verified that on the shooter's shoulder, several hundreds of kilograms are discharged, more or less, proportional to the type of cartridge and the weight of the firearm.

It is well-known that the overall energy of the shot which is discharged on the shooter's shoulder can be diluted with time or partially dispersed but never completely eliminated, the dilution with time and dispersion of part of the energy allows the effects on the shooter to be reduced, the firing accuracy to be increased, maintaining the target line for a possible subsequent shoot.

Various devices are known for the damping or reduction of recoil effects, in this field, the Applicant has prepared a recoil damping device described in US patent application 2006/0096148 and a recoil pad in composite material for rifles, object of U.S. Pat. No. 6,594,935.

The devices according to the above two disclosures, have an optimum functioning and provide more than satisfactory damping and adsorbing results. The Applicant, however, by developing the study and testing of recoil damping in firearms, with particular respect to long arms, has surprisingly discovered that it is possible to drastically reduce the recoil effects on the shooter by means of a mechanism suitable for distributing through time, and partially dispersing, the impulsive recoil forces.

According to the known art, the fixing of the stock to the body is effected by means of a centring bolt or screw, suitably threaded at the ends, fixed to the receiver and on which the stock, equipped with a pass-through longitudinal cavity, is engaged.

The stock is then tightened by means of a die to be inserted into the longitudinal cavity, under the recoil pad. The operation is completed by the assembly of the recoil pad. Even if the recoil is reduced, however, the known systems do not eliminate the high stresses inside the firearm, which cause its wear.

SUMMARY

The Applicant has consequently conceived a bolt suitable for connecting the stock made of wood or polymeric material, to the body, and, in particular, to the receiver, of a new conception equipped with a damping mechanism for damping the mobile masses which subsequently withdraw inside the receiver.

According to a first aspect of the present invention, a blocking bolt of the stock to a receiver of a semi-automatic firearm having movable masses, is provided, comprising a tubular element which can be closed at its ends by a bolt-body cap which can be screwed to the receiver and by a bolt-stock cap on which the stock can be tightened, wherein the tubular element houses in its interior a damping mechanism of the speed of the mobile masses of a semi-automatic firearm, not connected to these and destined to enter into contact with these only in the last tract of their withdrawal movement, following the firing of the firearm, to damp its speed, the impact on the receiver and recoil stress.

According to another aspect of the present invention, the above-mentioned damping mechanism of the mobile masses speed, is produced by means of damping elements in series and suitable for distributing through time and partially dispersing the recoil impulse of the mobile masses of the semi-automatic firearm.

Further characteristics of the invention are specified in the dependent claims.

BRIEF DESCRIPTION OF THE DRAWINGS

The characteristics and advantages of the stock bolt of a semi-automatic firearm equipped with a damping mechanism according to the present invention, will appear more evident from the following illustrative and non-limiting description, referring to the enclosed schematic drawings in which.

DETAILED DESCRIPTION

Figure 1A:
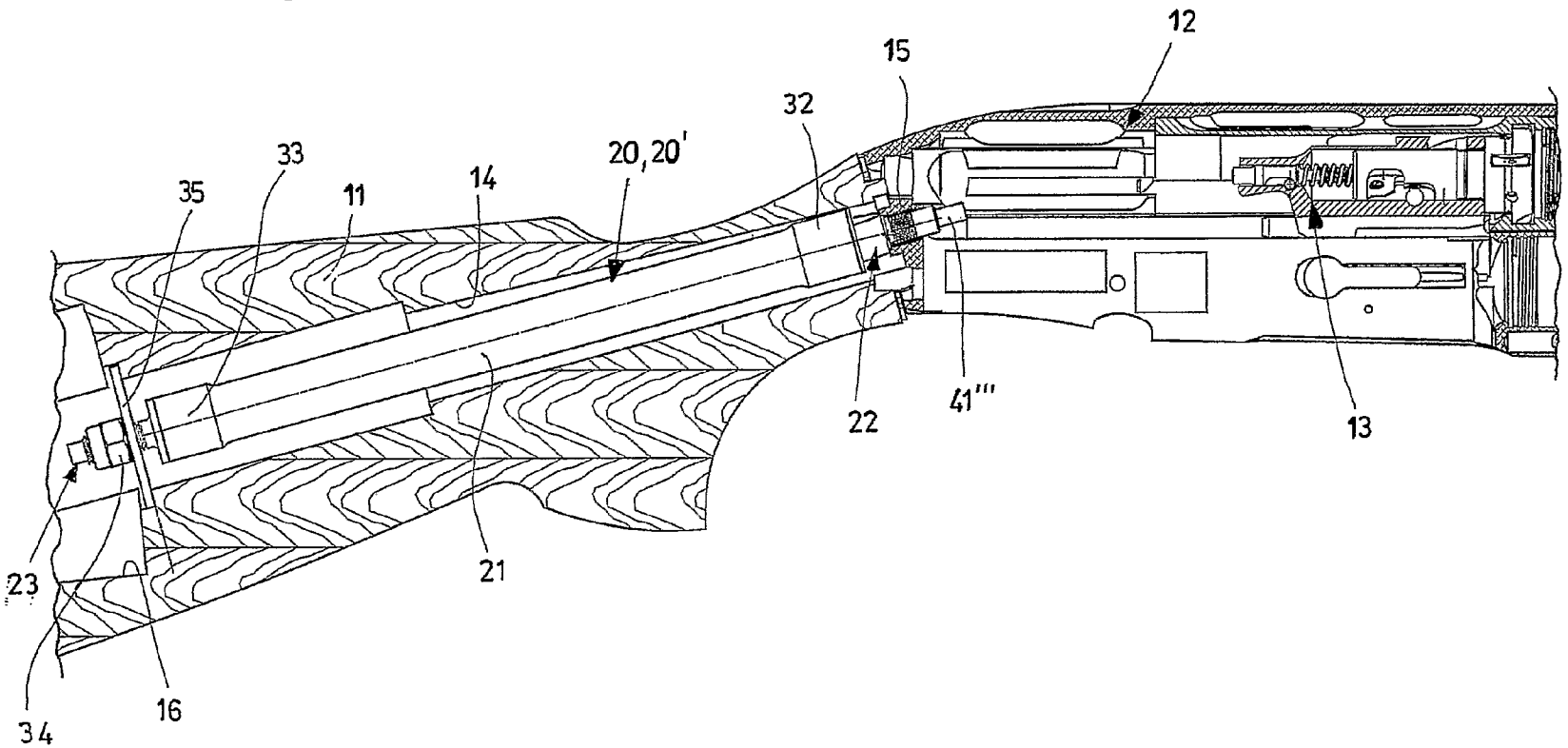
FIGS. 1*a*, 1*b* and 1*c* are schematic sectional side views of a portion of a long semi-automatic firearm, equipped with the bolt according to the invention, in the condition of closed breech bolt, with the breech bolt at half run, and with the breech bolt in contact with the bolt object of the invention, respectively.

With reference to the figures, a semi-automatic firearm has a stock 11 which can be fixed and tightened to a breech plane 15 of a receiver 12 by means of a bolt 20, 20' according to one of the two embodiments described.

The bolt 20, 20' is fixed to the breech plane 15, by screwing, so that it extends from the receiver 12 to receive the firearm stock 11.

For this purpose, the stock 11 is crossed by an open duct 14, possibly shaped and having a minimum diameter slightly larger than the diameter of the bolt 20, 20'.

The duct 14 widens into a chamber 16 open on the end portion of the stock, to allow the introduction of tightening means, for example a nut 34 with the relative washer 35 and possible means for the tightening of the bolt, which is closed by a recoil pad inserted on the stock.

The bolt 20, 20' comprises a tubular element 21, which can be closed at the outlet ends 32, 33 respectively by means of a bolt-body cap 22, which can be screwed to the breech plane 15 of the receiver 12, and by means of a bolt-stock cap 23, on which the stock 11 can be tightened.

In the bolt 20 according to the first embodiment, the tubular element 21 houses in its interior a damping mechanism 40 of the withdrawal speed of the mobile masses of the semiautomatic firearm.

The tubular element 21 is produced with a first and second outlet end 32, 33 having a larger diameter with respect to the body and having internal threads destined for the screwing of the two caps 22, 23.

The bolt-body cap 22 is produced in the form of a hollow body 26 with a substantially circular section, and has a first outer threading 24 for being screwed to the breech plane 15 and a second outer threading 28 for being screwed into the first end 32 of the tubular element, the two threaded portions being separated by an annular edge 27 having acting as run-end for the screwing of the cap 22 against the edge of the end 32 of the tubular element 21.

The bolt-stock cap 23, produced in the form of a hollow body, with an external threading 31 destined for being screwed into the second end 33 of the tubular element 21, is screwed to the second end 33 of the tubular element.

At the end of the threaded portion of the hollow body, an externally threaded pin 29 extends to receive the tightening means of the stock, for example, in the form of a nut 34 and washer 35, the latter having the function of blocking abutment of the bolt against the outlet edge of the duct 14 in the chamber 16.

An annular edge 30 is situated between the two threaded portions 31 and 29, with the function of screwing run-end of the bolt-stock cap 23 against the edge of the end 33 of the tubular element 21.

The damping mechanism 40 comprises, in sequence between the two caps 22 and 23, a pusher 41 partially housed inside the bolt-body cap 22 and a series of damping devices coaxially arranged inside the tubular element: a hydraulic damper 43 and a spacer 44 situated between said hydraulic damper 43 and the bolt-stock cap 23.

The series of damping devices coaxially arranged inside the tubular element can also include a spring 42 situated between said pusher 41 and said hydraulic damper 43, with the double function of cooperating with the damping of the withdrawal speed of the mobile masses and bringing the pusher 41 back to the original position when the recoil effect has worn off.

The damping mechanism 40 of the withdrawal speed of the mobile masses 13 of the semi-automatic firearm is not connected to the mobile masses 13 and is destined to enter into contact with the latter during their withdrawal movement following the firing of the firearm to damp the recoil stress, in particular, said contact occurs in a terminal phase of the withdrawal run of the mobile masses.

Figure 1B:
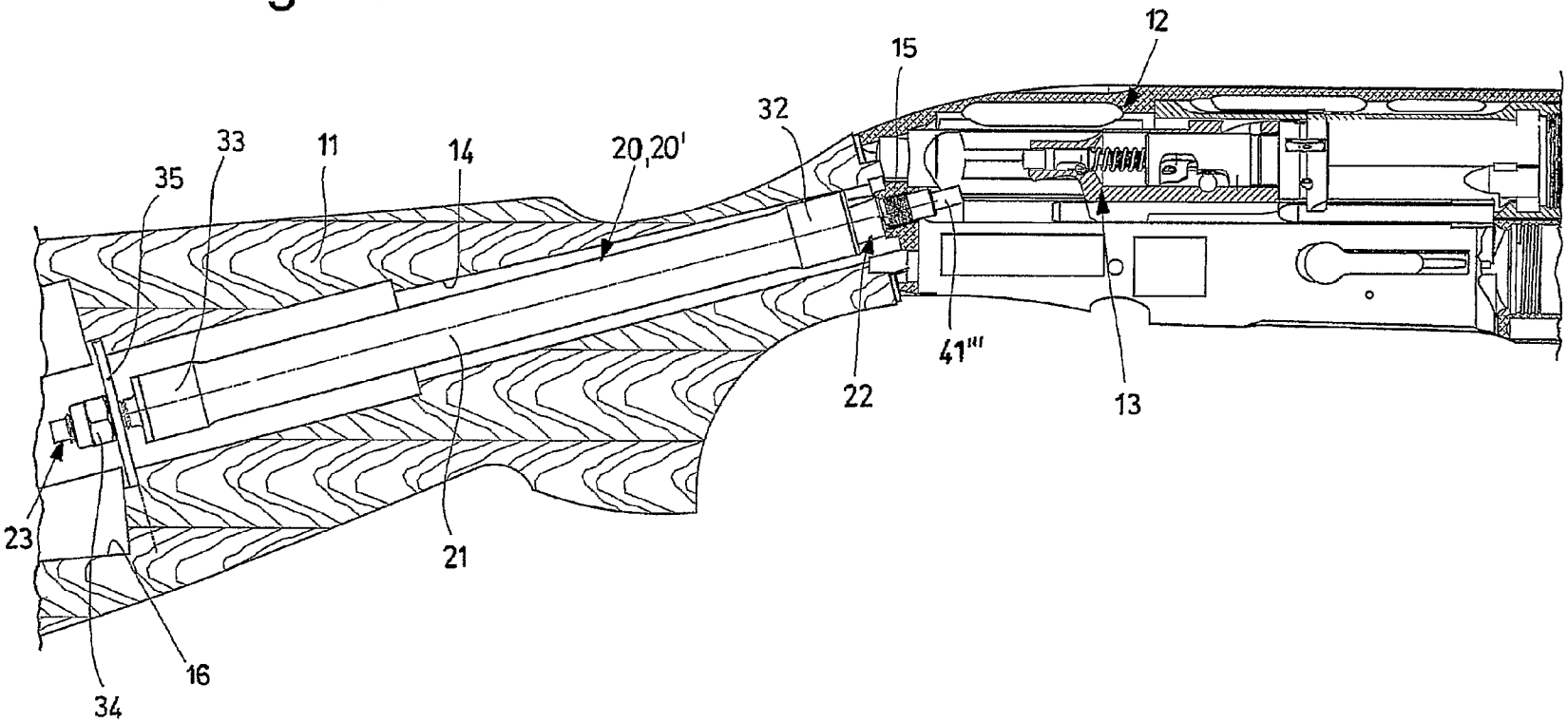
Figure 1C:
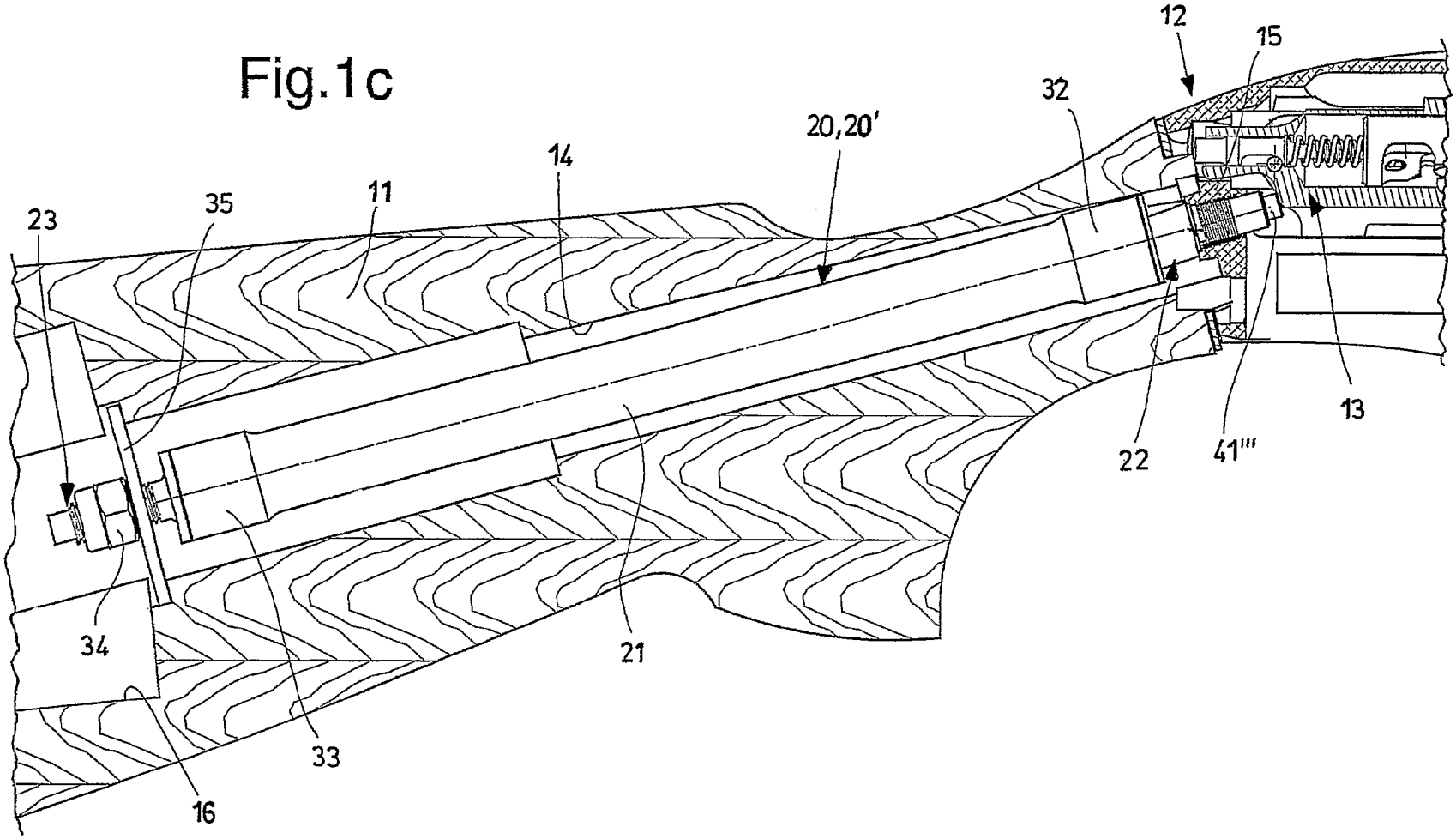
Figure 2:
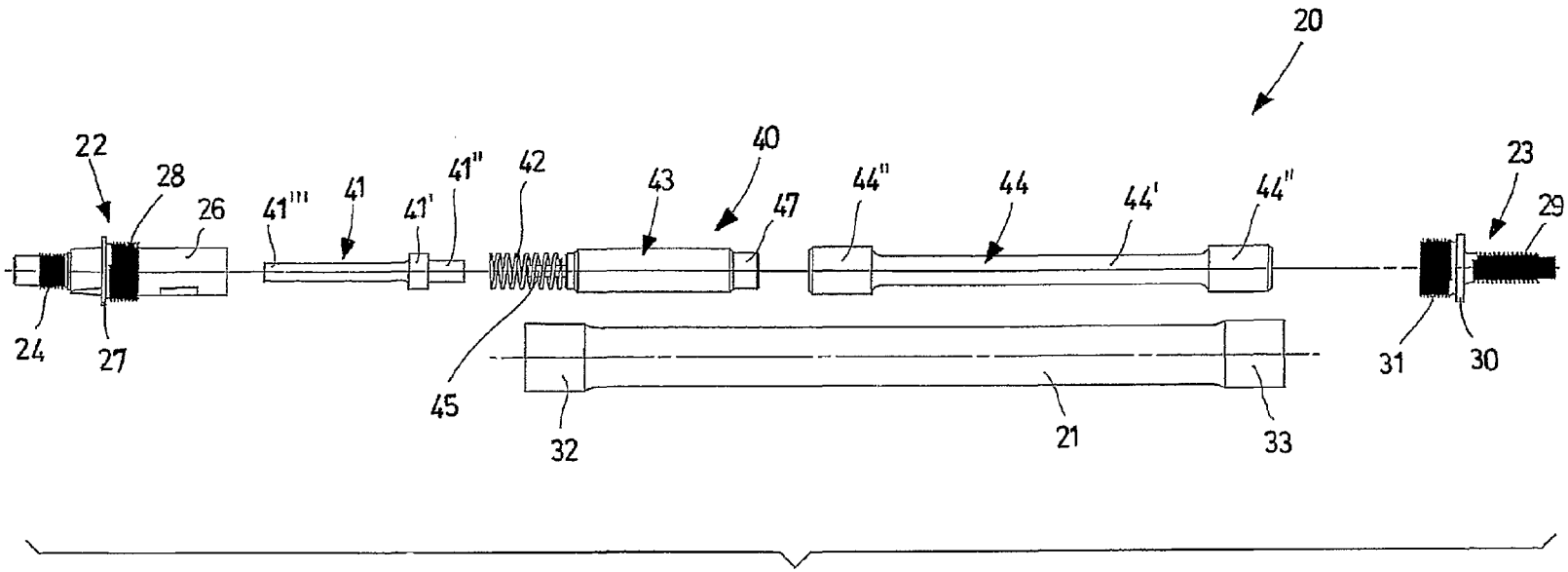
FIG. 2 is an exploded view of the bolt according to a first embodiment of the invention.
Figure 3:
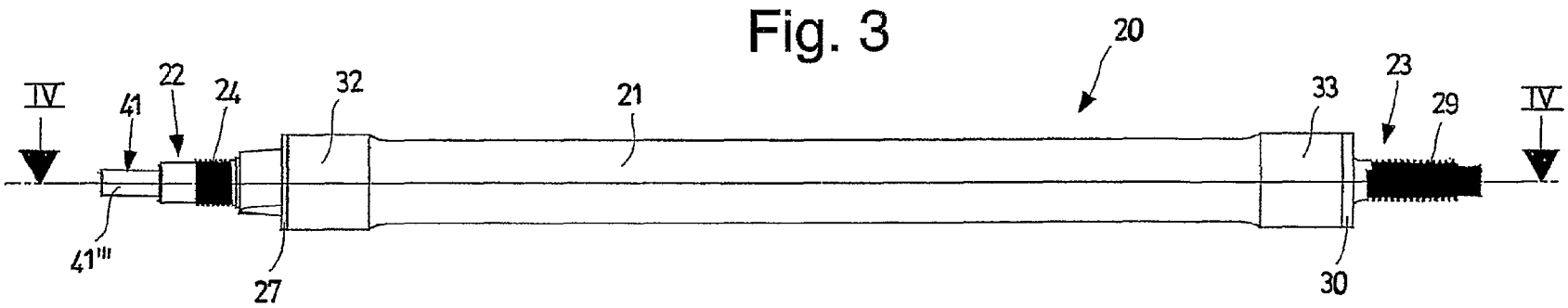
FIG. 3 is a side view of the bolt of FIG. 2 assembled.
Figure 4:
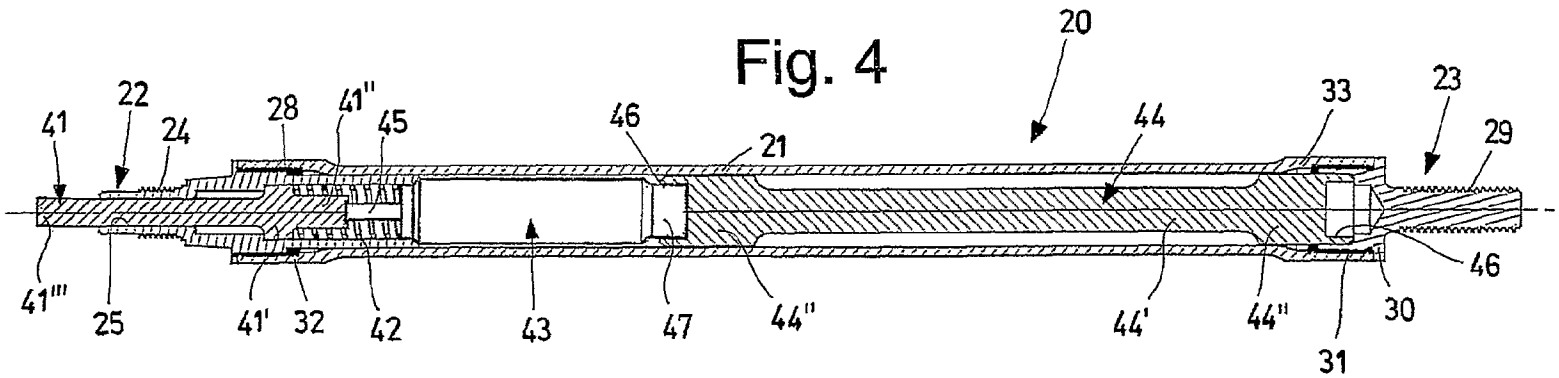
FIG. 4 is a view according to the section IV-IV of FIG. 3 of the bolt according to the invention.

FIGS. 1*a* to 1*c* show the approaching of the mobile masses 13, mainly consisting of the breech bolt slide, to the bolt 20, 20' object of the present invention, in a sequence during their backward run. Starting from figure la, in which the breech bolt is shown closed, after the opening of the same, the mobile masses 13 recede towards the bolt 20, 20' (FIG. 1*b*) until they come into contact with the bolt itself 20, 20', in particular with the protruding end of the pusher 41 (FIG. 1*c*).

The pusher 41 has an elongated form and, on one side, has a pin portion 41''' extending outside the bolt-body cap 22 forming a free end of the bolt 20, suitable for receiving the stress of the recoiling mobile masses 13 and transmitting it to the series of damping mechanisms. The damping mechanism 40, in fact, is situated on the withdrawal trajectory of the mobile masses 13 and the pin portion 41''' of the pusher 41 is a protruding end inside the receiver 12, which comes into contact with the mobile masses 13 only in the final phase of the shooting cycle, when the same withdraw after the opening of the breech bolt.

Following the impact between the mobile masses 13 and the pin portion 41''', the same recedes with respect to the bolt-body cap 22, as can be seen from the comparison between FIG. 1*b* and FIG. 1*c*, starting the activation of the damping mechanism.

At the opposite side, the pusher 41 is equipped with a small piston 41'', destined for being inserted inside the coils of the spring 42, when present, to come into contact with the head of the hydraulic damper 43.

Between the small piston 41'' and the pin portion 41''' there is an annular corresponding portion 41', which acts as a stop-end for compressing the spring 42, when present. The spring 42 is therefore, on one side, wedged onto said piston 41'' and, on the other side, in contact with the head of the hydraulic damper 43.

A plunger 45 extends from the head of the hydraulic damper 43, destined, in any case, with or without the spring 42, for contact with the small piston 41''.

The bottom 47 of the hydraulic damper 43 is put in contact with the spacer 44.

The spacer 44 is produced in a cylindrical, elongated form, symmetrical with respect to the transversal plane of centre-line and has a central body 44' ending with end portions 44'' having an enlarged section, equipped with seats 46 for receiving the bottom 47 of the hydraulic damper 43 indifferently inside either of the seats, according to the assembly.

The spacer 44 is advantageously made of polymeric material so as to have a certain elasticity for becoming deformed when subjected to stress by the impulsive recoil forces, thus providing its contribution to the damping.

Figure 5:
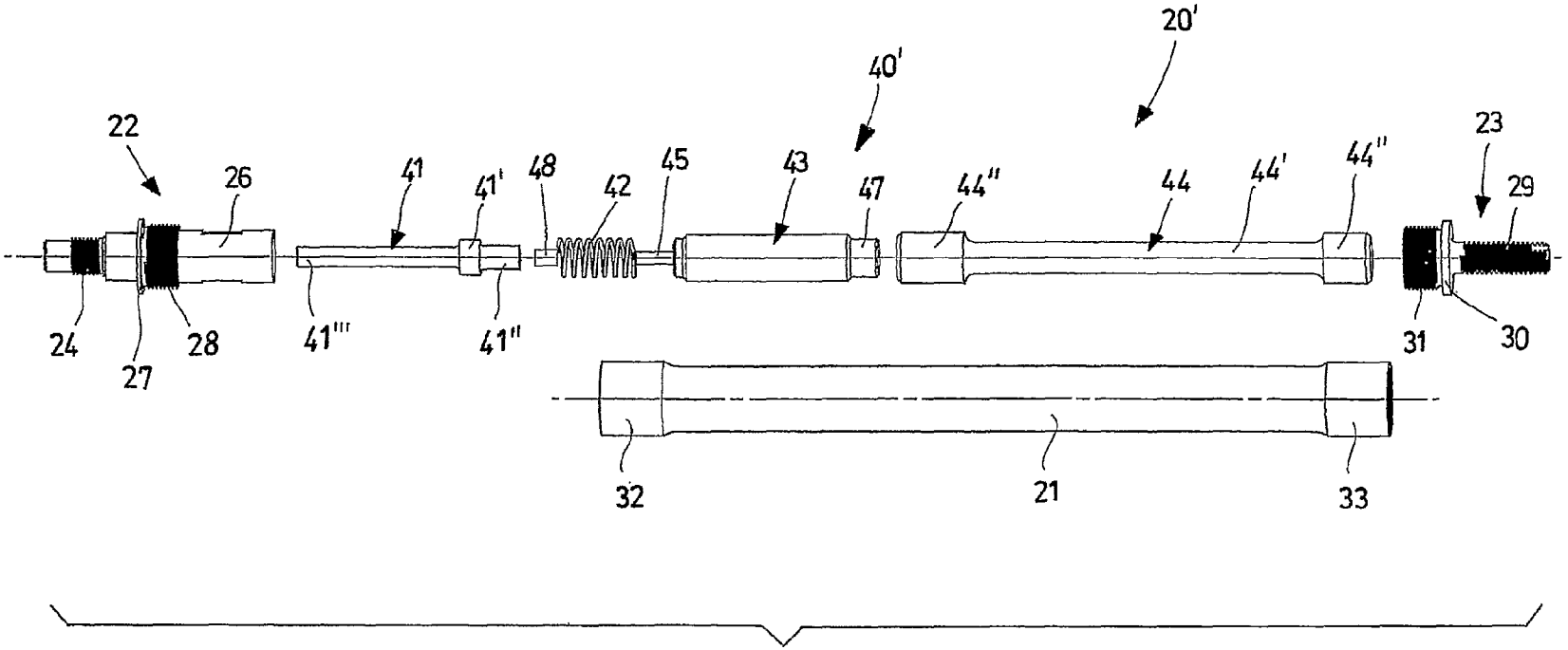
FIG. 5 is an exploded view of the bolt according to another embodiment of the invention.
Figure 6:
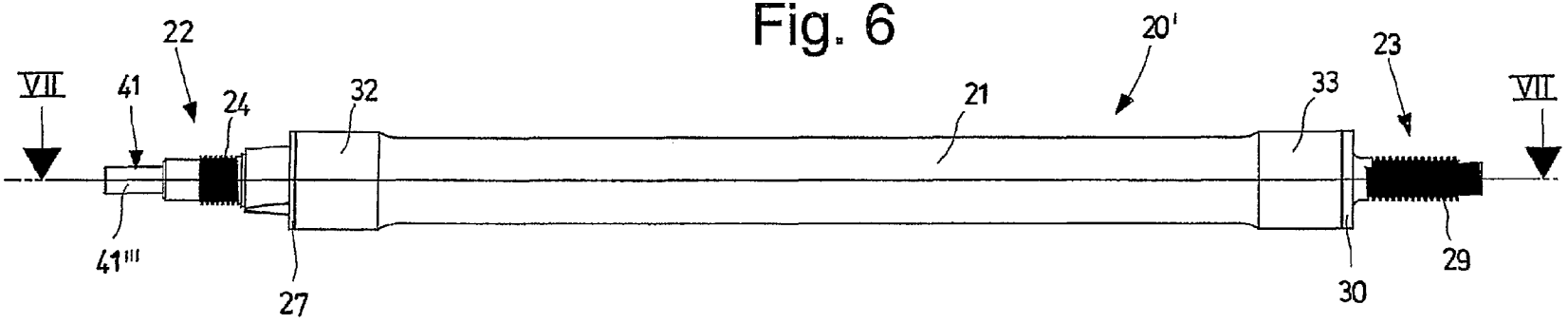
FIG. 6 is a side view of the bolt of FIG. 5 assembled.
Figure 7:
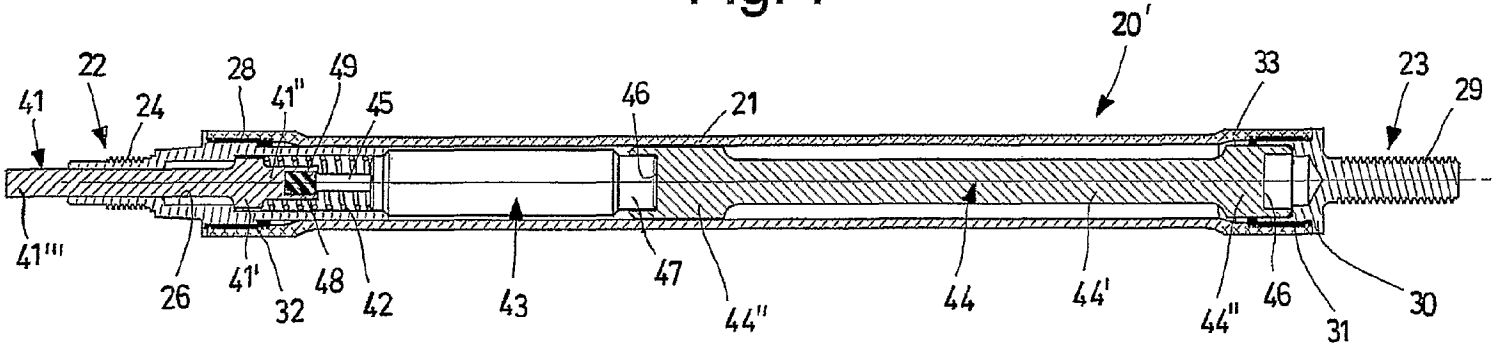
FIG. 7 is a view according to the section VII-VII of FIG. 6 of the bolt according to the invention.

The second embodiment of the bolt 20' according to the present invention, shown in FIGS. 5-7, only differs from the first embodiment in the addition to a recoil damping mechanism 40' of a further damping element 48 made of elastomeric material or other deformable polymer.

The damping element 48, cylindrical, for example, having a cylindrical shape, is contained in a complementary seat 49 situated at the end of the small piston 41'', of the pusher 41. When the bolt 20' is assembled, the plunger 45 of the hydraulic damper 43 is in contact with the damping element 48.

The damping element 48 cooperates with the damping of the mobile masses speed, in particular, protecting the plunger from the stress peaks generated by the impact of the mobile masses 13 against the pusher 41.

Figure 8:
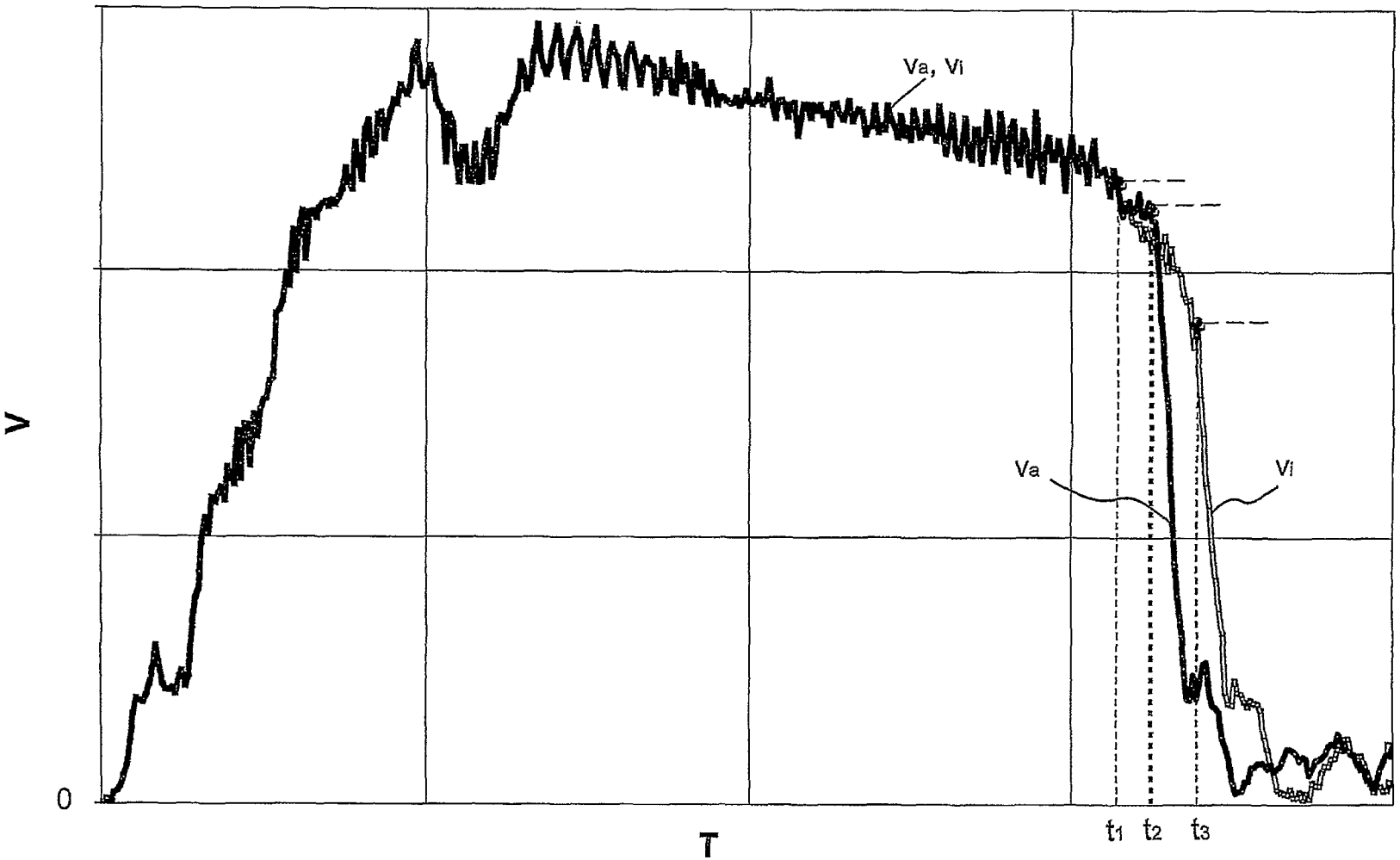
FIG. 8 is a graph which comparatively shows the speed of the movable masses with time in a firearm equipped with a traditional bolt and a firearm equipped with a bolt according to the present invention.

The graph of FIG. 8, which can be applied to both of the embodiments of the bolt 20, 20', object of the present invention, schematically demonstrates that the damping mechanism 40, 40', object of the present invention, only begins to operate at the end of the firing cycle, when the mobile masses, at the end of their backward movement inside the receiver, strike against the bolt 20, 20'.

The graph represents the trend of the absolute speed of the mobile masses 13, indicated on the axis V, in relation to the time, indicated on the axis T, in a firearm equipped with a traditional bolt rigidly constrained to the firearm (curve $v_a$) and in a firearm equipped with a bolt 20, 20' according to the present invention (curve $v_i$).

In the first withdrawal phase of, until the instant $t_1$, wherein the mobile masses 13 come into contact with the bolt 20, 20', the curve of the speeds of the mobile masses is common to the two cases shown, i.e. it is not influenced by the damping mechanism, 40, 40'. In the graph, the curves $v_a$ and $v_i$, overlap, in this tract.

Starting from the instant $t_1$, the curve $v_i$, relating to the trend of the speed in a firearm equipped with the damping mechanism 40, 40' according to the invention, begins to gradually and progressively decrease due to the effect of energy dissipation in the damping mechanism until the instant $t_3$, which corresponds to the run-end of the pack-joined damping elements and to the direct transmission of the recoil forces directly to the body of the firearm. After the instant $t_3$ there is a brusque and rapid dissipation of the forces directly on the body.

In a conventional firearm, at the instant $t_1$, there has been no contact with the traditional rigid bolt and the absolute speed of the mobile masses remain unchanged until the instant $t_2$, in which the mobile masses strike against the traditional rigid bolt, which brusquely disperses the forces, directly on the body.

The graph of FIG. 8, shows how the damping mechanism according to the invention in addition to dissipating the impulsive recoil forces, also advantageously distributes them with time.

The damping mechanism according to the present invention, in addition to being a recoil damper with benefits on the reduction of the recoil sensation on the shooter's shoulder, is mainly a damper of the withdrawal speed of the mobile masses before coming into contact with the receiver, with benefits on the duration of the firearm components.

The bolt, according to the invention, can be used in a semi-automatic firearm, preferably long, such as a rifle or carbine, or in a short, a semi-automatic firearm.

Among semiautomatic rifles, it can be assembled with no limitations with respect to the type of firearm, which can be of the sports type such as a single-barrel, rifled or unrifled shotgun.

The invention claimed is:

1. A bolt for locking a stock to a receiver of a firearm having mobile masses including a breech bolt slide, comprising:

a tubular element that is closed at first and second ends thereof;

a bolt-body cap that closes the first end of the tubular element, the bolt-body cap being screwed to a breech plane of the receiver; and a bolt-stock cap that closes the second end of the tubular element, the bolt-stock cap being tightened to the stock; and a damping mechanism housed at least partly within an interior of the tubular element, the mechanism damping a withdrawal speed of the mobile masses of the firearm, the damping mechanism including a free end that is aligned with a withdrawal trajectory of the breech bolt slide of the mobile masses, the free end not being connected to the mobile masses, and the free end being positioned in the withdrawal trajectory so as to damp stress via contact with the breech bolt slide during a withdrawal movement of the breech bolt slide following a firing of the firearm.

2. The bolt according to claim 1, wherein said damping mechanism comprises, in a sequence between the bolt-body cap and the bolt-stock cap;

a pusher partially housed inside the bolt-body cap, and a series of damping devices coaxially arranged inside the tubular element, the series of damping devices including a hydraulic damper, and a spacer situated between said hydraulic damper and the bolt-stock cap.

3. The bolt according to claim 2, wherein said pusher has an elongated form and includes a pin portion disposed at a first end of the pusher, the pin portion extending outside the bolt-body cap to directly receive the stress due to the withdrawal movement of the mobile masses upon recoiling and to transmit the stress to the series of damping devices, and a small piston disposed at a second end of the pusher, the small piston contacting the hydraulic damper during the withdrawal movement of the breech bolt slide.

4. The bolt according to claim 3, wherein a plunger extends from a head of the hydraulic damper such that, during the withdrawal movement of the breech bolt slide, the plunger contacts said small piston and a bottom of the hydraulic damper contacts the spacer.

5. The bolt according to claim 4, wherein said small piston comprises a damping element made of a deformable polymer, the damping element being contained in a complementary seat situated at an end of the small piston.

6. The bolt according to claim 4, wherein said spacer has an elongated cylindrical form, symmetrical with respect to a central transversal plane, the spacer including a central body that terminates on each end thereof with an enlarged section, each enlarged end including a seat, and wherein the seat adjacent the hydraulic damper receives the bottom of the hydraulic damper.

7. The bolt according to claim 6, wherein said spacer is made of a polymeric material.

8. The bolt according to claim 3, wherein a spring is interposed between said pusher and said hydraulic damper.

9. The bolt according to claim 8, wherein the small piston is inserted inside coils of the spring to come into contact with the hydraulic damper, and wherein an annular corresponding portion is disposed between the small piston and the pin portion, the annular corresponding portion being a stop-end for compressing the spring.

10. The bolt according to claim 1, wherein the bolt-body cap includes a hollow body with a substantially circular section, a first outer threading screwed to the breech plane, and a second outer threading screwed into the first end of the tubular element, wherein the first and second outer threading are separated by an annular edge which is a run-end for screwing the bolt-body cap against an edge of the first end of the tubular element.

11. The bolt according to claim 1, wherein the bolt-stock cap is screwed into the second end of the tubular element, the bolt-stock cap including a hollow body having an external threading screwed into the second end of the tubular element, an pin extending from an end of the external threading of the hollow body, the pin having external threading extending to connect with tightening means of the stock, the tightening means including a nut and a washer, and an annular edge disposed between the external threading of the hollow body and the external threading of the pin, the annular edge being a run-end for screwing the bolt-stock cap against an edge of the second end of the tubular element.

12. The bolt according to claim 1, wherein the tubular element includes a body and the first and second ends disposed opposite each other on the body, wherein a diameter of the first and second ends, respectively is larger than a diameter of the body, and wherein the first and second ends each have inner threadings to which is screwed, respectively, one of the bolt-body cap and the bolt-stock cap.

13. A semiautomatic firearm comprising a bolt according to claim 1.

14. A semi-automatic firearm, comprising:

the bolt according to claim 1, wherein the firearm is one of a short firearm and a long firearm.

15. The semi-automatic firearm according to claim 14, wherein the firearm is the long firearm and is one of a carbine and single-barrel rifle, which is one of rifled and unrifled.

16. The bolt according to claim 5, wherein the damping element of the small piston is made of an elastomer.

* * * * *